United States Patent [19]

Kaimann et al.

[11] 4,165,971

[45] Aug. 28, 1979

[54] APPARATUS FOR THE GASIFICATION OF CARBONACEOUS MATERIAL

[75] Inventors: Walter Kaimann, Rietberg; Karl-Heinz Brachthaüser, Ratingen, both of Fed. Rep. of Germany

[73] Assignee: Projektierung Chemische Verfahrenstechnik GmbH, Dusseldorf, Fed. Rep. of Germany

[21] Appl. No.: 797,872

[22] Filed: May 17, 1977

[30] Foreign Application Priority Data

May 19, 1976 [DE] Fed. Rep. of Germany ..... 2622265

[51] Int. Cl.[2] ..... C10J 3/30

[52] U.S. Cl. ..... 48/77; 48/86 R; 48/101; 202/118; 264/141; 414/158

[58] Field of Search ..... 48/86 R, 77, 76, 101, 48/210; 44/10 C, 13, 10 G; 201/6, 22, 24; 202/118; 214/17 B, 17 C, 17 A, 17 CA, 17 CB; 222/194, 410; 264/140, 141, 176 R

[56] References Cited

U.S. PATENT DOCUMENTS

| | | | |
|---|---|---|---|
| 749,302 | 1/1904 | Koneman | 48/86 R |
| 956,902 | 5/1910 | McCan | 44/13 |
| 3,414,640 | 12/1968 | Garetto et al. | 264/140 |
| 3,910,775 | 10/1975 | Jackman | 44/13 |
| 4,003,717 | 1/1977 | Cass et al. | 44/13 |
| 4,057,400 | 11/1977 | Kaimann et al. | 48/86 R |

FOREIGN PATENT DOCUMENTS

| | | | |
|---|---|---|---|
| 988301 | 5/1976 | Canada | 44/10 C |
| 48-24410 | 7/1973 | Japan | 264/141 |
| 262901 | 12/1926 | United Kingdom | 214/17 B |
| 327679 | 3/1930 | United Kingdom . | |
| 787195 | 12/1957 | United Kingdom . | |
| 1239368 | 7/1971 | United Kingdom . | |

*Primary Examiner*—S. Leon Bashore
*Assistant Examiner*—George C. Yeung
*Attorney, Agent, or Firm*—Holman & Stern

[57] ABSTRACT

A process and apparatus for material processing, in particular for producing gas from carbon-containing material, are disclosed. Feed material comprising particulate material is continuously formed into briquettes and is simultaneously introduced into a processing compartment. The feed material is formed into briquettes by one or more pressure wheels forcing the material through channels in a die.

4 Claims, 6 Drawing Figures

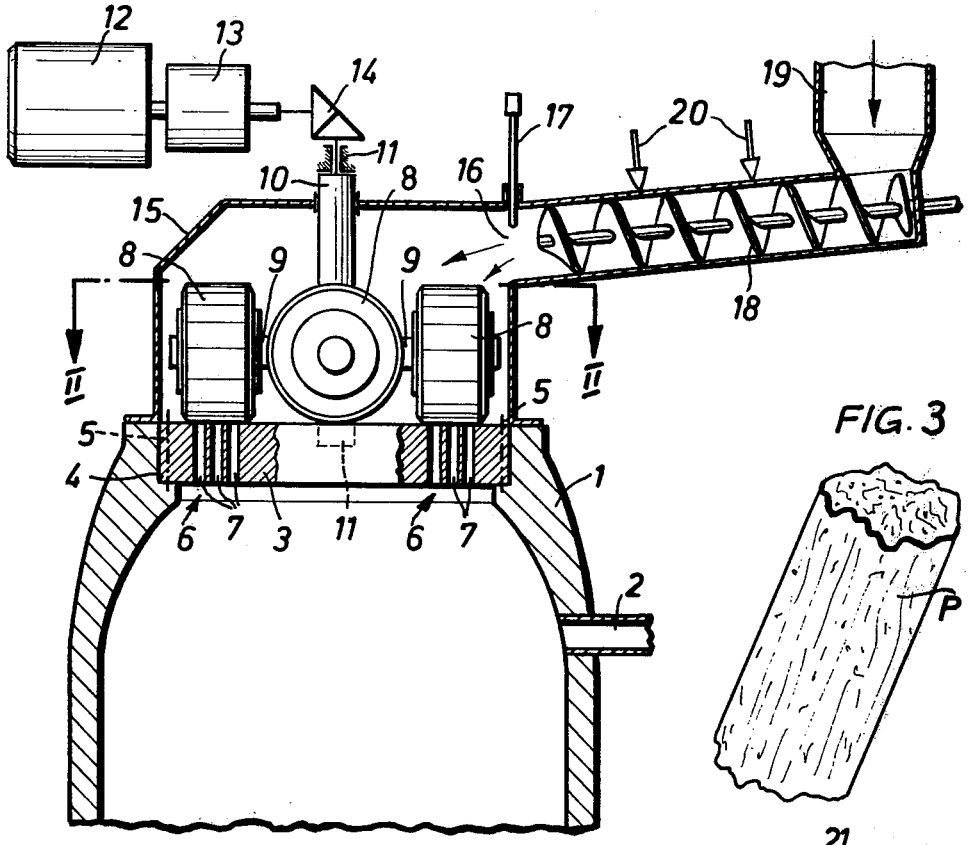
FIG. 1
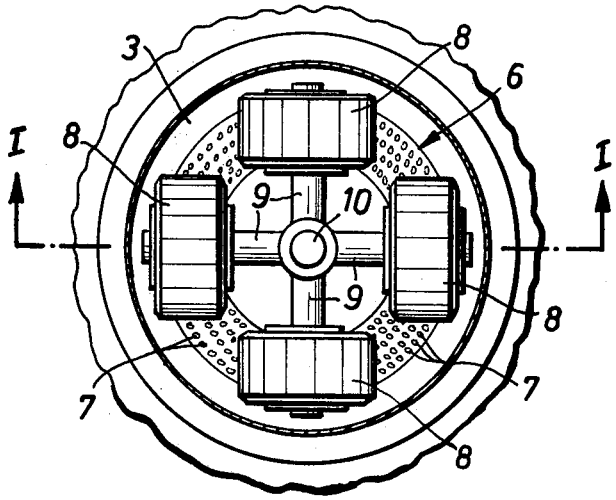
FIG. 2
FIG. 3
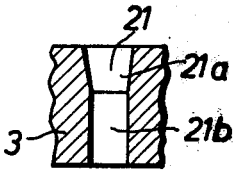
FIG. 4
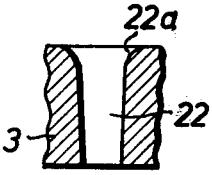
FIG. 5
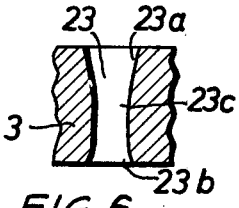
FIG. 6

APPARATUS FOR THE GASIFICATION OF CARBONACEOUS MATERIAL

This invention relates to a process and apparatus for material processing, in particular (but not solely) in the production of gas from coal or other carbon-containing feed material.

There are various carbon-containing materials available in comparatively large quantities, but of such an external form, e.g. as a slurry, powder, or granules of small particle size, that their utilisation is accompanied by great difficulties or indeed up to the present time has not been economically possible. This is the case inter alia for so-called ballast coal. This is a coal containing a high proportion of inerts, and in particular a product representing the inert-rich fraction originating from the separation process used in the refining of rough coal, which because of its physical properties cannot be classified either as mine waste or as coal.

What is desired is a satisfactory method for processing feed material, and in particular to make it possible to produce gas from coal or carbon-containing feed material of a type which because of its external form has not up to the present time been able to be processed or refined or has been so only with great difficulty or with great expense.

According to the invention, a feed material consisting at least partly of a granular or powdery material is formed continuously into a simultaneously occurring quantity of briquettes on introducing the material into a processing compartment.

By this means pieces are produced which, because of their size, their state, and the quantity produced per unit time, are very suitable for processing or treatment, in particular for gas production, even from material which up to the present time has not appeared suitable as a feed material for this purpose. The process according to the invention particularly makes possible the utilisation of so-called undersize, i.e. material with a particle size in the range of 6 to 10 mm or less, whether it be undersize of ballast coal or of other material.

Where a binder is necessary for forming the briquettes, consideration may be given inter alia particularly to the use of slurry coal and/or pulverised waste or refuse, in particular that containing a high proportion of paper. In addition other binders such as tar or pitch may be used.

A particularly suitable apparatus for effecting the aforesaid process is in the form of a type of edge mill press, and comprises a die disposed in the passageway of the material and containing a plurality of channels disposed in an annular region, and at least one pressure wheel or the like, rolling on the upper end of the die in the region of the channels.

With such an apparatus, granular or powdery material is pressed by the pressure wheel or wheels into the die channels, whereby it is consolidated in the channels by skin friction and emerges in this form continually from the bottom of the die. It has been found that the pressed pieces produced in this manner from coal or carbon-containing material break off when they have reached a certain length after leaving the die. By this means briquettes are produced in a size which is particularly suitable for a gas production process.

The apparatus according to the invention may be used not only for feeding material to a pressureless container or generator but is also suitable for supplying feed material to a pressure system, especially a coal pressure gasifier. The die can then be in the form a pressue flange. It has been found that solidly pressed carbon-containing material in the die channels is gas-tight up to high pressures. Thus an otherwise-necessary costly lock is no longer required. This represents a great advantage.

The apparatus may be used not only with feed material for coal gasification but is also suitable for continuously feeding solids of other types to a treatment or processing vessel or reactor and in particular a pressure vessel.

The invention will be described further, by way of example only, with reference to the accompanying drawing, in which:

FIG. 1 is a section through apparatus for processing feed material, taken substantially on line I—I in FIG. 2;

FIG. 2 is a section on the line II—II of FIG. 1;

FIG. 3 shows a briquette produced by the apparatus; and

FIGS. 4 to 6 are axial sections of various embodiments of channels in a die.

The embodiment of the apparatus shown in FIGS. 1 and 2 serves for feeding a generator for producing gas from coal or coal-containing feed material, in particular ballast coal undersize. The generator may be either a pressure gasifier or a pressureless generator, such as a revolving grate generator with a low temperature carbonisation attachment. The vessel portion 1 shown in FIGS. 1 and 2 may form part of a pressure vessel, a low temperature carbonisation cell or any other processing vessel. The reference numeral 2 indicates an outlet line.

The upper end of the vessel portion 1 comprises a circular recess 4 into which a die 3 is inserted. The die 3 may be connected to the vessel portion 1, for example by bolts 5, shown only in FIG. 1, or any other suitable fixing means, and may also be made pressure-tight against the vessel portion if necessary.

The die 3 is provided with a plurality of channels 7 in an annular region 6. Four pressure wheels 8 run on the upper surface of the die 3, their width being somewhat greater than the width of the annular region 6 containing the channels 7, so that when the pressure wheels 8 rotate the annular region 6 becomes fully covered and is thus acted upon by the weight of the pressure wheels and the pressure which is set up by them.

The pressure wheels 8 are rotatably supported on horizontal axles 9, which are rigidly connected to the lower part of a vertical shaft 10. This shaft 10 extends from bearings 11 and is driven by an electric motor 12 at a required speed of rotation, via a gear unit 13 and a bevel gear pair 14.

The pressure wheels 8 run in a closed housing 15 provided with an inlet opening 16 for the feed material, for example a granular fuel. The cross-section of the inlet opening 16 may be varied or shut by a valve 17. A rotatably driven screw 18 is connected to the inlet opening 16, and by means of the screw 18 the feed material, fed via a hopper 19, may be metered and if necessary further prepared, e.g. mixed with additives or binders. The arrows 20 indicate feed openings for an additive, such as slurry coal.

The material fed by the screw 18 to the housing 15 is pressed by the rotating pressure wheels 8 into the channels 7 of the die 3, and leave the die in the form of solid extrusions which on reaching a certain length break off under the action of gravity and/or the temperature in the vessel 1, so that a large number of briquettes are continuously and simultaneously formed, and fall into the vessel portion 1 or the generator. FIG. 3 shows such a briquette P of a size attainable by the apparatus.

The channels 7 of the die 3 may be cylindrical as shown in FIG. 1, or may have a different form according to the type of feed material and the required state of the briquette. Thus, FIG. 4 shows a channel 21 with an upper conical portion 21*a* and a lower cylindrical portion 21*b*, FIG. 5 a downward tapering conical channel 21 with a widening upper end 22*a*, and FIG. 6 a rotationally symmetrical channel 23 which comprises contracting portions within its ends 23*a*, 23*b* and a narrower cylindrical portion 23*c* intermediate its ends. The lower outlet cross-section at 23*b* is in this case smaller than the upper inlet cross-section at 23*a*.

We claim:

1. Apparatus for producing gas from carbonaceous material, comprising a pressure vessel having an upper end formed with an opening, a stationary die mounted in said upper end of said vessel, means connecting said die to the upper end of said vessel, said die having an annular region defining a plurality of channels extending between upper and lower surfaces of the die, a housing above said die, said housing having an inlet for carbonaceous material and at least one pressure wheel positioned in said housing to roll over the upper surface of said die in said annular region to press the carbonaceous material into and through said channels whereby the material leaves the channels as solid extrusions adapted to break off and form briquette-like pieces suited for a gas production process within said vessel, the carbonaceous material pressed into said channels of the die forming pressure-tight seals between said lower and upper surfaces of said die.

2. Apparatus as claimed in claim 1, in which the channels are of cylindrical form at least over part of their height.

3. Apparatus as claimed in claim 1 in which the channels narrow downwards at least over part of their height.

4. Apparatus as claimed in claim 1, in which the channels comprise a narrower portion intermediate their ends.

* * * * *